US006188306B1

(12) United States Patent
Wollesen

(10) Patent No.: US 6,188,306 B1
(45) Date of Patent: Feb. 13, 2001

(54) ON-CHIP TRANSFORMERS

(75) Inventor: Donald L. Wollesen, Saratoga, CA (US)

(73) Assignee: Advanced Micro Devices, Inc., Sunnyvale, CA (US)

( * ) Notice: Under 35 U.S.C. 154(b), the term of this patent shall be extended for 0 days.

(21) Appl. No.: 08/985,915

(22) Filed: Dec. 5, 1997

Related U.S. Application Data

(62) Division of application No. 08/691,053, filed on Aug. 1, 1996, now Pat. No. 5,877,667.

(51) Int. Cl.[7] ..... H01F 5/00; H01F 27/28

(52) U.S. Cl. ..... 336/200; 336/223; 336/232

(58) Field of Search ..... 336/200, 232, 336/223, 115, 116, 121

(56) References Cited

U.S. PATENT DOCUMENTS 4,494,100 * 1/1985 Stengel et al. ..... 336/200

* cited by examiner

*Primary Examiner*—Ahn Mai
(74) *Attorney, Agent, or Firm*—H. Donald Nelson

(57) ABSTRACT

Various embodiments of on chip-transformers constructed in separate metal layers in an insulator that serves as a dielectric which is formed on a substrate such as a silicon substrate. Windings with currents flowing in a first direction are constructed in a first metal layer and windings with currents flowing a second direction are constructed in a second metal layer. Windings in the first metal layer are connected to windings in the second metal layer by connectors such as vias. The transformer can be constructed in a balun layout, an autotransformer layout, a layout with the secondary separated from the primary, a layout with the secondary separated the primary and rotated with respect to an axis of the primary, a layout in which the transformer is a two stage transformer and with the first stage constructed orthogonal to the second stage, or a transformer in which the windings are constructed in a toroidal layout.

2 Claims, 11 Drawing Sheets

42

ON-CHIP TRANSFORMERS

This application is a division of application Ser. No. 08/691,053 filed Aug. 1, 1996 which application is now U.S. Pat. No. 5,877,667.

BACKGROUND OF THE INVENTION

1. Field of the Invention

This invention relates generally to semiconductor integrated circuit devices and more particularly, to transformers manufactured on semiconductor integrated circuit chips and even more particularly, to transformers manufactured on semiconductor integrated circuit chips that can be used at video and radio frequencies as well as other applications.

2. Discussion of the Related Art

There have been various attempts shown in the prior art to construct workable chip type transformers. One such attempt is shown in U.S. Pat. No. 5,497,137 entitled "Chip type transformer" issued to Yasuhiro Fjuiki of Nagaokakyo, Japan in which a balun type transformer is constructed as a chip type transformer in which there is a laminate having five dielectric substrates superimposed on one another. A ground connection is formed on one main surface of the first dielectric substrate and a ground connection is formed on the main surface of the fifth dielectric substrate. A connecting electrode is formed on one main surface of the second dielectric substrate and a first strip line is formed on one main surface of the third dielectric substrate. The first strip line consists of a first spiral portion and a second spiral portion. A second spiral strip line and a third spiral strip line are formed on one main surface of the fourth dielectric substrate and the second strip line and the third strip line are electromagnetically connected with the first portion of the first strip line and the second portion respectively.

Another such attempt is disclosed in U.S. Pat. No. 4,547,961 entitled "Method of manufacture of miniaturized transformer" and invented by Bokil and Morong and discloses a miniaturized thick-film isolation transformer comprising two rectangular substrates each carrying successive screen-printed thick-film layers of dielectric with spiral planar windings embedded therein. The spiral windings comprise conductors formed of fused conductive particles embedded within a layer of dielectric insulating means solidified by firing at high temperature to form a rigid structure with the windings hermetically sealed within the dielectric and conductively isolated from each other within the transformer. The substrates are formed at opposite ends thereof with closely adjacent connection pads all located at a single level to accommodate automated connection making and connections between the pads and the windings are effected by conductors formed of fused conductive particles. The substrates and the dielectric layers are formed with a central opening in which is position the central leg of a three-legged solid magnetic core. The remaining portions of the core surround the two substrates to form a compact rugged construction especially suitable for assembly with hybrid integrated circuit components.

U.S. Pat. No. 4,785,345, entitled "Integrated transformer structure with primary winding in substrate" and invented by Rawls and Turgeon, and discloses an integrated transformer structure. In one embodiment, the primary transformer winding is formed using dielectrically isolated technology to isolate high voltages applied to the transformer from other components in the substrate. Alternatively, conventional junction isolated technology may be used, where physical separation between the integrated transformer and other components may be provided. The primary winding comprises a planar spiral formed with a low-resistivity material and incorporated with the substrate and an insulating layer formed over the primary winding. A planar spiral configuration is also used to form the secondary winding and is formed on top of the insulating layer directly above the primary winding.

U.S. Pat. No. 4,717,901 entitled "Electronic component, especially for a chip inductance" and invented by Autenrieth, Marth, and Schindler, discloses an electronic component which includes a solid core part having a perpendicular prismatic spatial shape and lateral surfaces, the core part having a recess in the form of a blind hole formed therein defining a winding space, and electrical contact layers disposed on at least some of the lateral surfaces of the core part.

U.S. Pat. No. 5,477,204 entitled "Radio frequency transformer" and invented by Li, discloses a transformer having a substrate on which two substantially adjacent runners are disposed. The two runners have substantially the same width and the same length and run from one segment of the substrate to another forming two spirals which run in opposite directions.

U.S. Pat. No. 5,414,402 entitled "Multi-layer substrate" and invented by Mandai, Kato, and Tojyo, discloses a multi-layer substrate which should be used with an inductor. The multi-layer substrate has an internal coil which is connected with the inductor electrically and the internal coil has such an inductance value that the total inductance of the inductor and the internal coil is a specified value.

None of the prior art shows a simple construction of a transformer that can be constructed easily and simply on a semiconductor integrated circuit chip. What is needed is transformer layout that can be adapted for use in different and diverse applications including IF, RF, and Video frequencies in which the magnetic coupling between the primary and secondary can be designed and obtained during manufacture.

SUMMARY OF THE INVENTION

In accordance with the present invention an on-chip transformer is described having an insulator layer and a first and second metal layer within the insulator layer with currents flowing in one direction in the first metal layer and currents flowing in the opposite direction in the second metal layer.

One embodiment of the present invention is a transformer in an autotransformer layout in which nodes can be tapped to provide selected primary to secondary ratios.

A second embodiment of the present invention is a transformer in a balun layout.

A third embodiment of the present invention is a transformer having a primary constructed separated from a secondary wherein the secondary is constructed separated from the primary by a selected distance with the axis of the primary and the axis of the secondary coincident.

A fourth embodiment of the present invention is a transformer having a primary constructed separated from a secondary wherein the secondary is constructed separated from the primary by a selected distance with the axis of the secondary rotated by a selected angle and the secondary separated from the primary by a selected distance.

A fifth embodiment of the present invention is a transformer having a primary constructed separated from a secondary wherein the secondary is constructed separated from the primary by a selected distance along the axis of the primary and by a selected distance in which the axis of the secondary is displaced from the axis of the primary. The secondary can also be rotated around its centroid by a selected angle.

A sixth embodiment of the present invention is a two stage transformer having a first stage constructed separated from a second stage wherein the second stage is constructed separated from the first stage by a selected distance and where the axis of the first stage is orthogonal to the axis of the second stage.

A seventh embodiment of the present invention is a transformer with windings constructed in four metal layers within an insulator which is formed on a substrate such as a silicon substrate. The portions of the windings in one metal layer are connected to portions of the windings in other metal layers by connectors such as vias.

An eighth embodiment of the present invention is a transformer with windings constructed in three metal layers within an insulator which is formed on a substrate such as a silicon substrate. The portion of the primary winding with current flowing in a first direction is in the same metal layer as the portion of the secondary winding with current flowing in the first direction.

A ninth embodiment of the present invention is a transformer with windings constructed in a toroidal layout with portions of windings in a first metal layer and portions of windings in a second metal layer. The portions of the windings in the first metal layer are connected to portions of the windings in the second metal layer by connectors such as vias.

A tenth embodiment of the present invention is a transformer with three "windings" constructed in a toroidal layout.

The present invention is better understood upon consideration of the detailed description below, in conjunction with the accompanying drawings. As will become readily apparent to those skilled in this art from the following description there is shown and described a preferred embodiment of this invention simply by way of illustration of the mode best suited to carry out the invention. As it will be realized, the invention is capable of other different embodiments, and its several details are capable of modifications in various, obvious aspects all without departing from the scope of the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate the present invention, and together with the description serve to explain the principles of the invention. In the drawings.

DETAILED DESCRIPTION

Figure 1A:
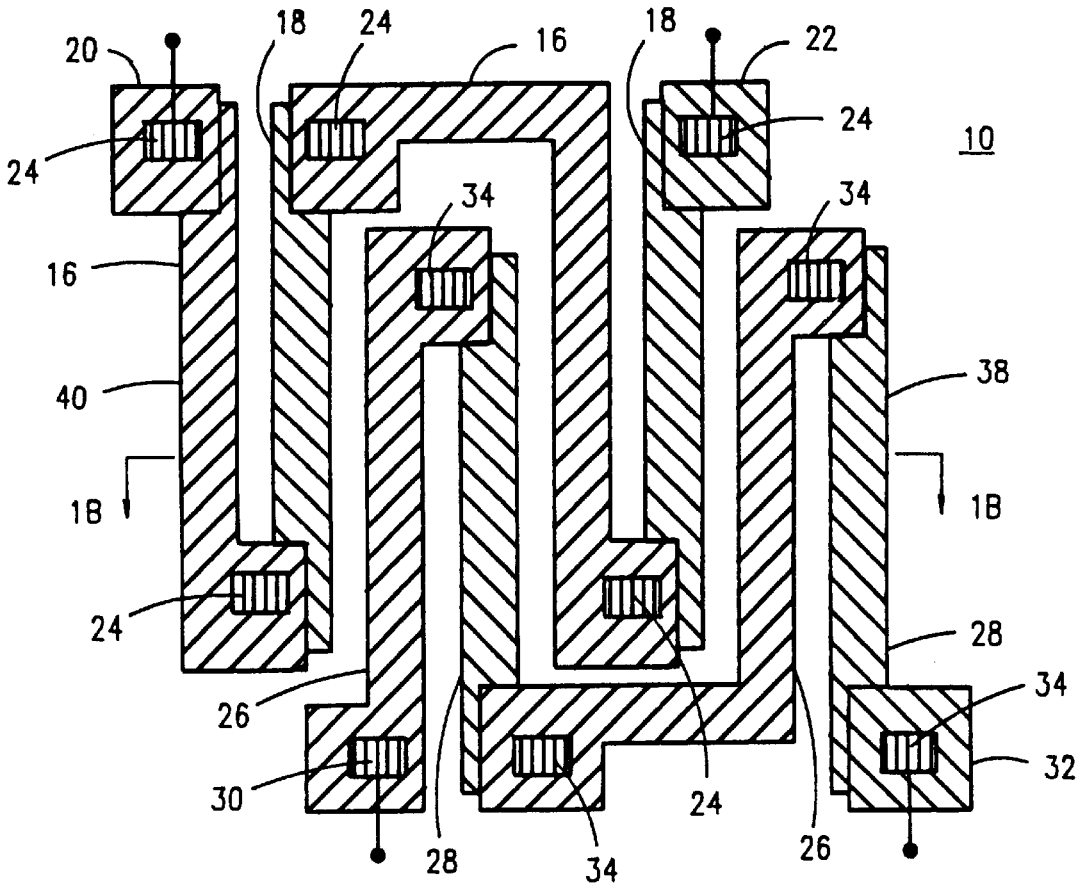
FIG. 1A is an embodiment of the present invention showing a plan view of an on-chip transformer.
Figure 1B:
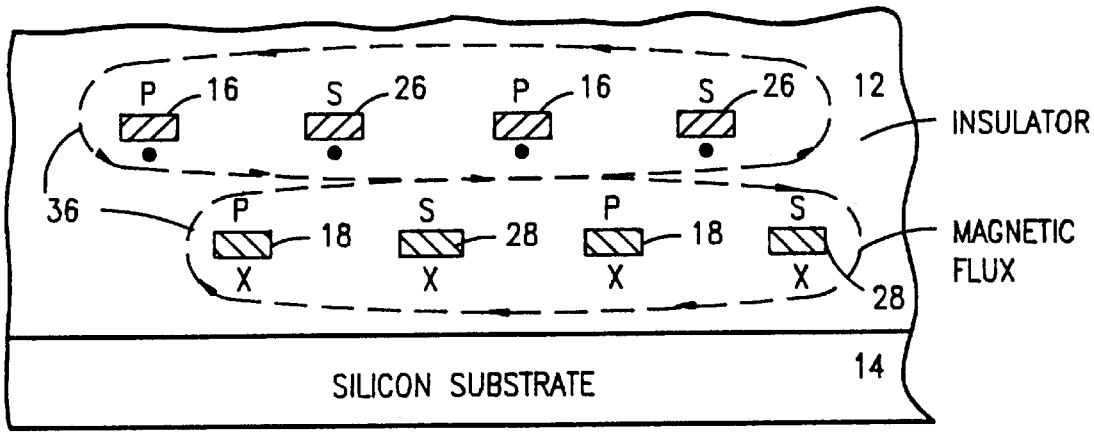
FIG. 1B is a cross-sectional view of the on-chip transformer shown in FIG. 1A.

Referring now to FIGS. 1A and 1B there is an on-chip chip transformer 10 with a two turn primary "winding" and a two turn secondary "winding" for a 1:1 turns ratio. FIG. 1A is a plan view and FIG. 1B is a cross-sectional view taken at a section indicated by arrows 1B. Referring to FIG. 1B the on-chip transformer 10 is constructed in an insulator layer 12 that serves as a dielectric. The insulator layer 12 is formed on a silicon substrate 14 by conventional methods well known in the semiconductor manufacturing art. Referring to FIG. 1A the layout of the on-chip transformer 10 is as follows. The primary of the transformer 10 is constructed in two metal layers embedded in the insulator layer 12. The portion of the primary constructed in one metal layer is indicated at 18 and the portion of the primary constructed in a second metal layer is indicated at 16. The pad 20 allows primary portion 16 to be connected to circuitry outside insulator 12 and pad 22 allows primary portion 18 to be connected to circuitry outside insulator 12. The plugs 24 connect portions of the primary in one metal layer 16 with portions of the primary in the second metal layer 18. The secondary of transformer 10 is also constructed in two metal layers embedded in the insulator 12. The portion of the secondary constructed in one metal layer is indicated at 28 and the portion of the secondary constructed in a second metal layer is indicated at 26. The numerals "18" and "28" define a first metal layer and the numerals "16" and "26" define a second metal layer. The pad 30 allows secondary portion 26 to be connected to circuitry outside insulator 12 and pad 32 allows secondary portion 28 to be connected to circuitry outside insulator 12. The plugs 34 connect portions of the secondary in one layer of the metal 28 with portions of the secondary in the second metal layer 26. The dashed lines 36 in FIG. 1B show the paths of the magnetic flux that exists in the insulator 12. As can be appreciated, the close proximity of the integrated circuit wire layout, the magnetic flux, indicated at 36, will be good and the "Q" of the transformer will be superior to a spiral transformer. Also, as can be appreciated, a spiral to spiral transformer with one spiral on top of the other cannot be done with a simple 2 layer metal process technology as illustrated in FIGS. 1A and 1B. In addition, it is to be understood that the explanation of a 1:1 ratio transformer is not limiting. For example, if in FIGS. 1A and 1B the right-most "turn" indicated at 38 is removed, the primary to secondary ratio would then be 2:1. Alternately, if the leftmost "turn" indicated at 40 of the primary is removed the primary to secondary ratio would then be 1:2. It is also to be understood that "turns" can be added to either the primary or the secondary to achieve ratios such as 3:2, 2:3, 3:1, 1:3, 10:1, 1:10, etc. The dot in the cross-sectional views of the "windings" indicate that the current is flowing out of the face of the figure and the "x's" indicate that the current is flowing into the face of the diagram.

Figure 2:
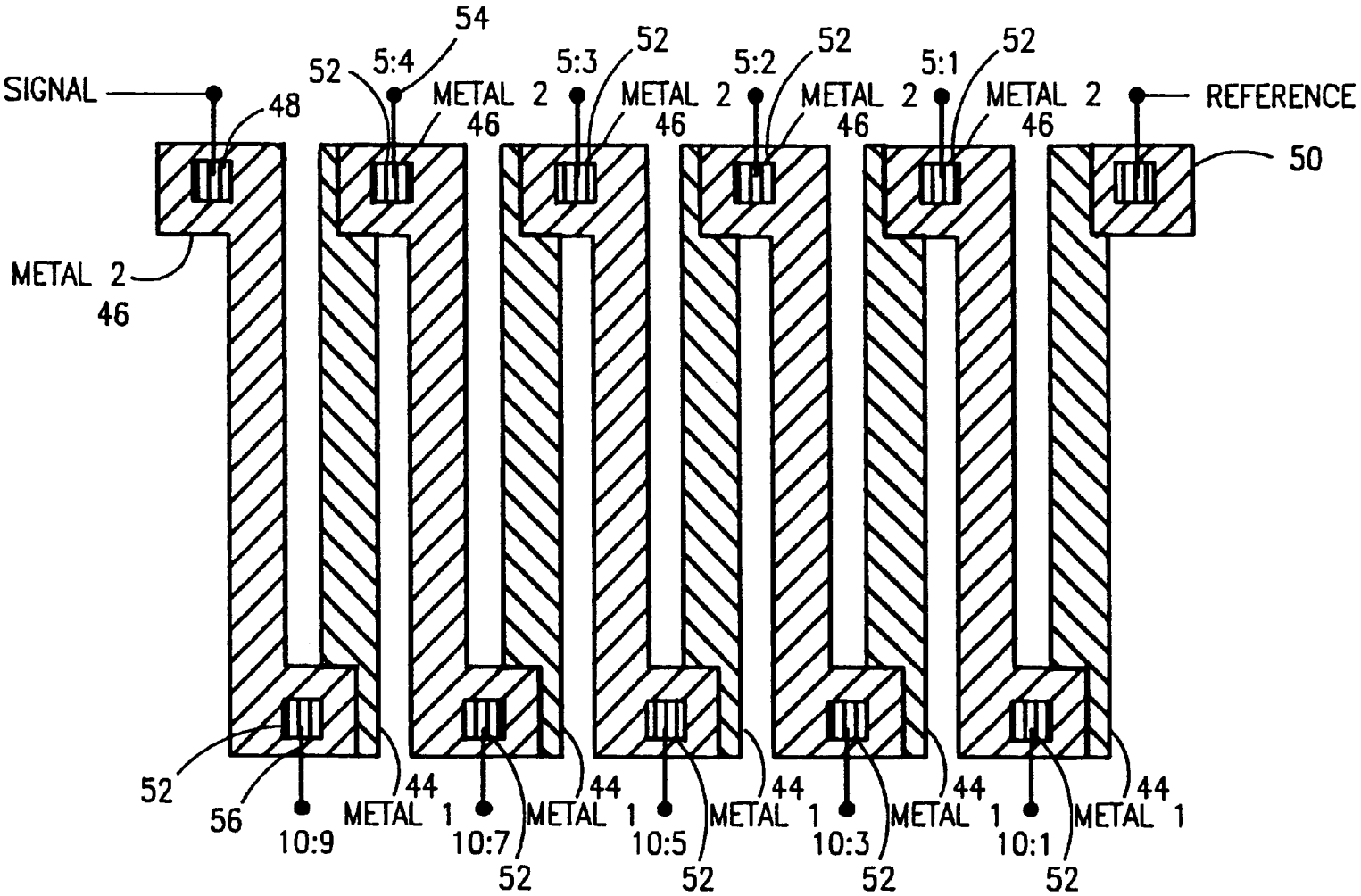
FIG. 2 shows a tapped auto-transformer.

Referring now to FIG. 2 there is shown an on-chip, non-isolated or "tapped" autotransformer 42 that can be formed in two metal layers in a dielectric in the same way that the on-chip transformer 10 shown in FIGS. 1A and 1B is formed. The windings of the autotransformer 42 are manufactured in two layers, a metal 1 layer, indicated at 44, and a metal 2 layer, indicated at 46. The plug, or via, 48, allows a signal to be input to the autotransformer 42. The plug, or via, 50, allows a signal to be referenced from the autotransformer 42. Plugs, or vias, 52, connect portions of the autotransformer 42 in metal layer 1 with portions of the autotransformer 42 in metal layer 2. As indicated in FIG. 2 any node can be a contact to provide a selected turns ratio. For example, the node indicated at 54 provides a turns ratio of 5:4 and the node indicated at 56 provides a turns ratio of 10:9. Other turns ratios are noted in the figure. The arrows 51 and the arrow 53 indicate the relative directions of the current that flows in the windings of the autotransformer 42.

Figure 3A:
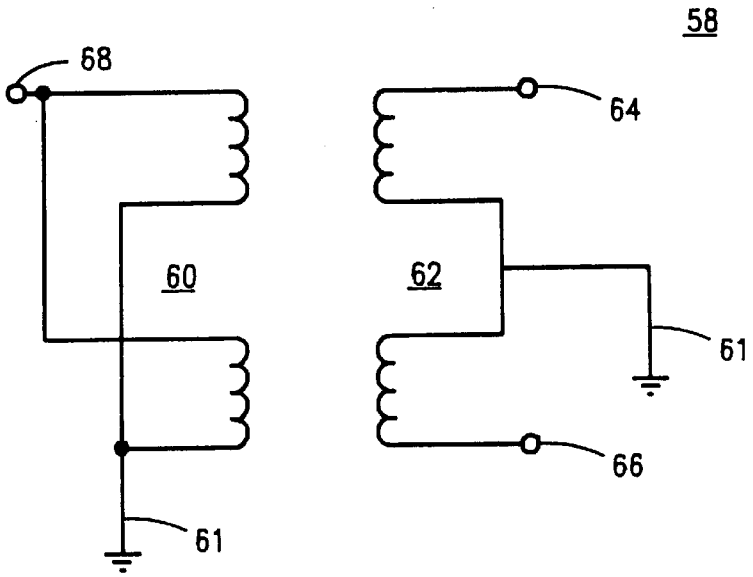
FIG. 3A shows a schematic diagram of a Balun transformer.
Figure 3B:
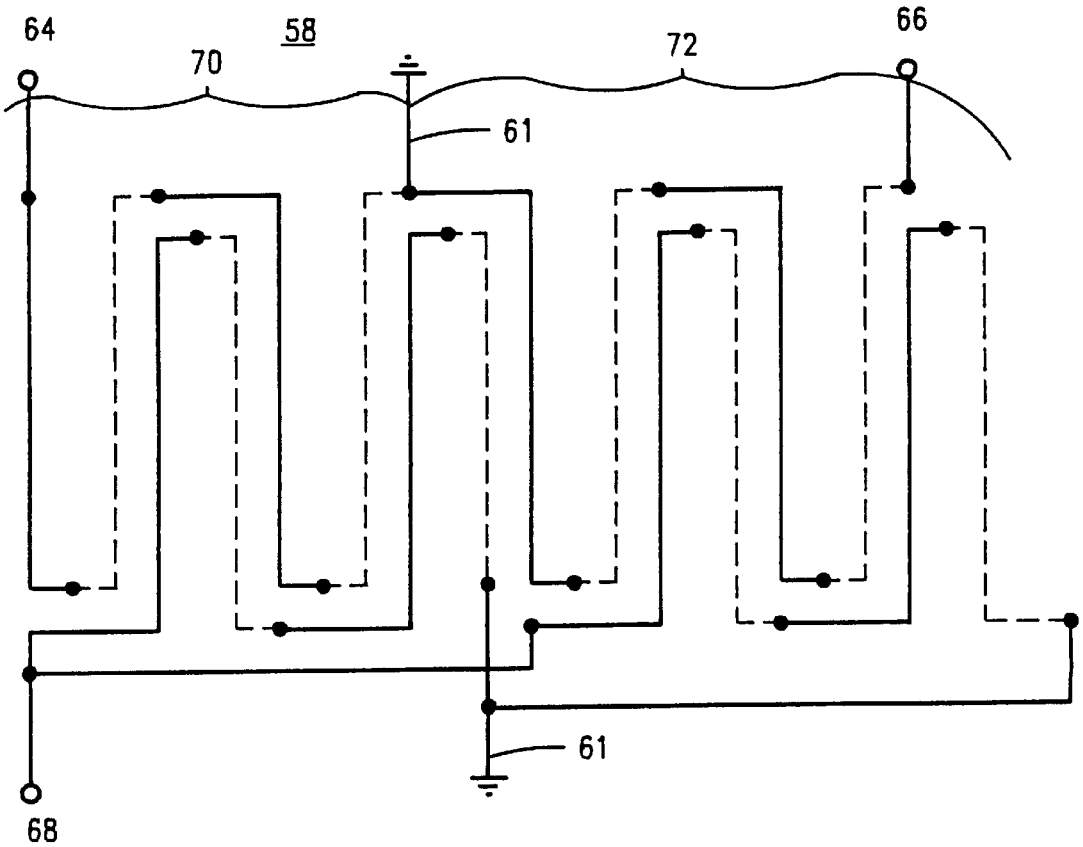
FIG. 3B shows a plan view layout of the Balun transformer schematic shown in FIG. 3A.

Referring now to FIGS. 3A and 3B there is shown a "Balun" transformer 58. The balun transformer is a device to convert the signal of a balanced transmission and the signal of an unbalanced transmission line into each other. The word "balun" is an abbreviation of "balanced-unbalanced." Referring to FIG. 3A the unbalanced portion of the balun is indicated at 60 and the balanced portion of the balun is indicated at 62. The balanced portion 62 has two lines 64 and 66, forming a pair, thus transmitting a signal as the potential difference between the two lines. One advantage of the balanced portion is that external noise affects the two signal lines of the balanced transmission line equally, thus is offset, and therefore the external noise does not appreciably affect the balanced transmission line. This advantage of a balanced transmission line is utilized, for example, in an analog integrated circuit which constitutes a differential amplifier and therefore many input-output terminals of an analog integrated circuit are of the balanced type, that is, the input-output terminals input signals to the circuit and output them therefrom as a voltage difference between the two input-output terminals.

A balun transformer, such as 58, shown in FIGS. 3A and 3B, has three input/output terminals, 64, 66, and 68 and ground 61. In order to convert the signal of the unbalanced transmission line 68 and that of the balanced transmission line into each other, the unbalanced transmission line 68 is connected with the input/output terminal via 68 and ground 61, while two signal lines of the balanced transmission line are connected with the input/output terminals 64 and 66. The balun transformer 58 takes out the signal of the portion between the two signal lines 64 and 66, thus supplying the signal to a portion between the two signal lines of the balanced transmission line, or takes out the signal of the portion between the two signal lines of the balanced transmission line, thus supplying the signal to the unbalanced transmission line.

In FIG. 3B and subsequent figures the dashed lines represent a "winding," either a portion of a secondary or a primary in a first metal layer, while the solid lines represent the other portion of the secondary or primary in a second metal layer. The dots connecting the dashed line with the solid line represent a plug or via connecting the portions of the windings in the first metal layer with the portions of the windings in the second metal layer.

Referring again to FIG. 3B the windings connecting terminal 64 with terminal 66 represent the balanced portion 62 of the balun 58 and the other windings connected between terminal 68 and ground represent the unbalanced portion 60 of the balun 58. It is noted that the transformer in FIGS. A and 1B is one-half of a balun layout and that the portion of the balun indicated at 70 and the portion of the balun indicated at 72 have the same layout as the transformer in FIGS. 1A and 1B.

The transformers discussed up to this point are constructed with rectangular wires on the semiconductor, integrated circuit chip and that any on-chip conductive material may be used, but the lower the resistance, the better. For example, polycide is better than polysilicon, aluminum better than polycide, copper better than aluminum and the ultimate choice is a choice made by the design engineer taking into account the process used in making the semiconductor integrated circuit in view of the application for which the semiconductor integrated circuit is to be used. Likewise, any insulator may be used, but to minimize the parasitic capacitance in the semiconductor integrated circuit, an insulator with a low k dielectric is better. For example, air is better than $SiO_2$ and $SiO_2$ is better than silicon nitride.

In addition, the transformers described in FIGS. 1A–3B are intended for maximum (tight) coupling which is required for many radio frequency (RF) and video transformers, especially Baluns. However, loosely coupled transformers such as "critically tuned" bandpass transformers used in many intermediate frequency (IF) applications also have utility. In some of these applications, it is important that the coupling of such transformers be designed to maximize amplitude "flatness" across the pass band frequencies or in the alternative that the coupling be designed to have a constant phase across the passband. Another desirable use for loosely coupling a primary to a secondary is to couple oscillators loosely to a load so that the load has little influence on the stability of the oscillator. Loosening the primary to secondary coupling can be achieved by increasing the separation between the primary and the secondary. The coupling proximity can be varied by varying the spacing either in line (on axis) or placing the secondary winding off axis from the primary including having the secondary windings at an angle from the primary windings up to and including having the secondary windings orthogonal to the primary windings in which case the magnetic flux coupling is very small or near to a null.

Figure 4:
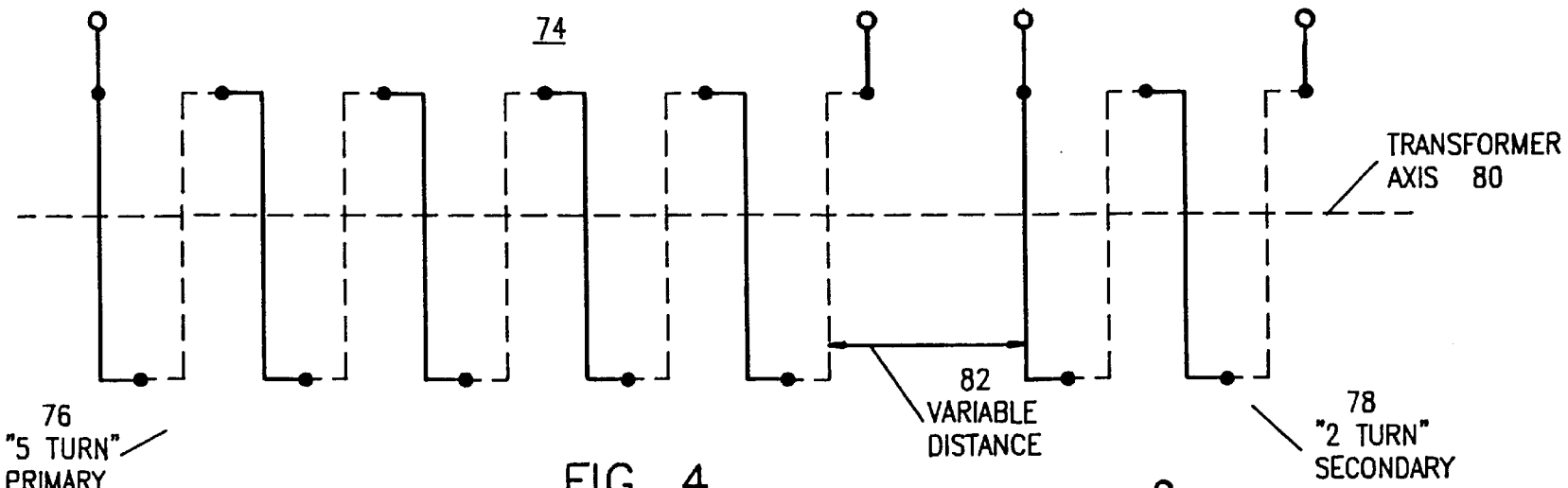
FIG. 4 illustrates a method of varying the coupling coefficient with a variable on-axis distance between primary and secondary.

Referring to FIG. 4, there is shown a transformer 74 with a "five turn" primary, indicated at 76, and a "two turn" secondary, indicated at 78. The axis of the secondary is coincident with the axis of the primary as indicated at 80. The coupling between the primary 76 and the secondary 78 is adjusted during manufacture by manufacturing the secondary 78 a selectable distance, indicated at 82, from the primary 76.

Figure 5:
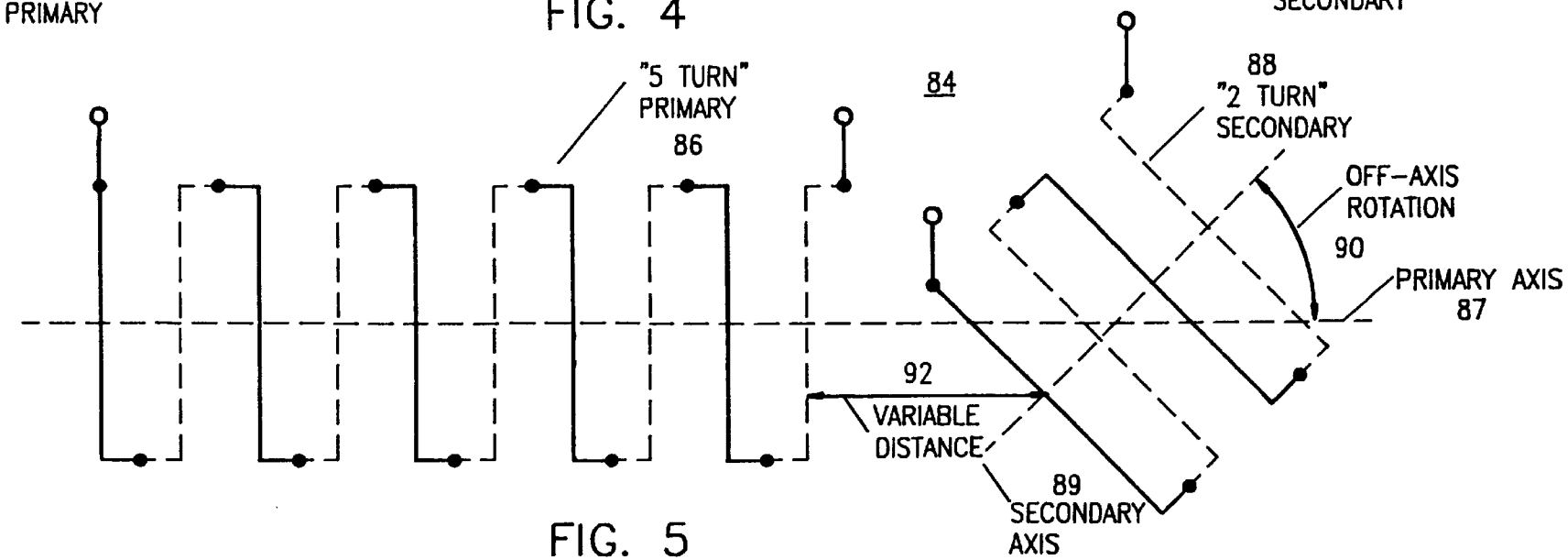
FIG. 5 illustrates a method of varying the coupling coefficient with a variable on-axis distance between primary and secondary and a variable off-axis rotation of the secondary relative to the primary.

Referring to FIG. 5, there is shown a transformer 84 with a "five turn" primary, indicated at 86, and a "two turn" secondary, indicated at 88. The primary 86 has a primary axis, indicated at 87, and the secondary 88 has a secondary axis, indicated at 89. The secondary 88 is rotated by a selectable angle 90, relative to the axis 87 of the primary. In addition, the secondary 88 is manufactured at a selectable distance 92 from the primary 86. In this case, the coupling is varied approximately as a function of the cosine of the angle 90 the secondary is rotated and as a function of the distance 92.

Figure 6:
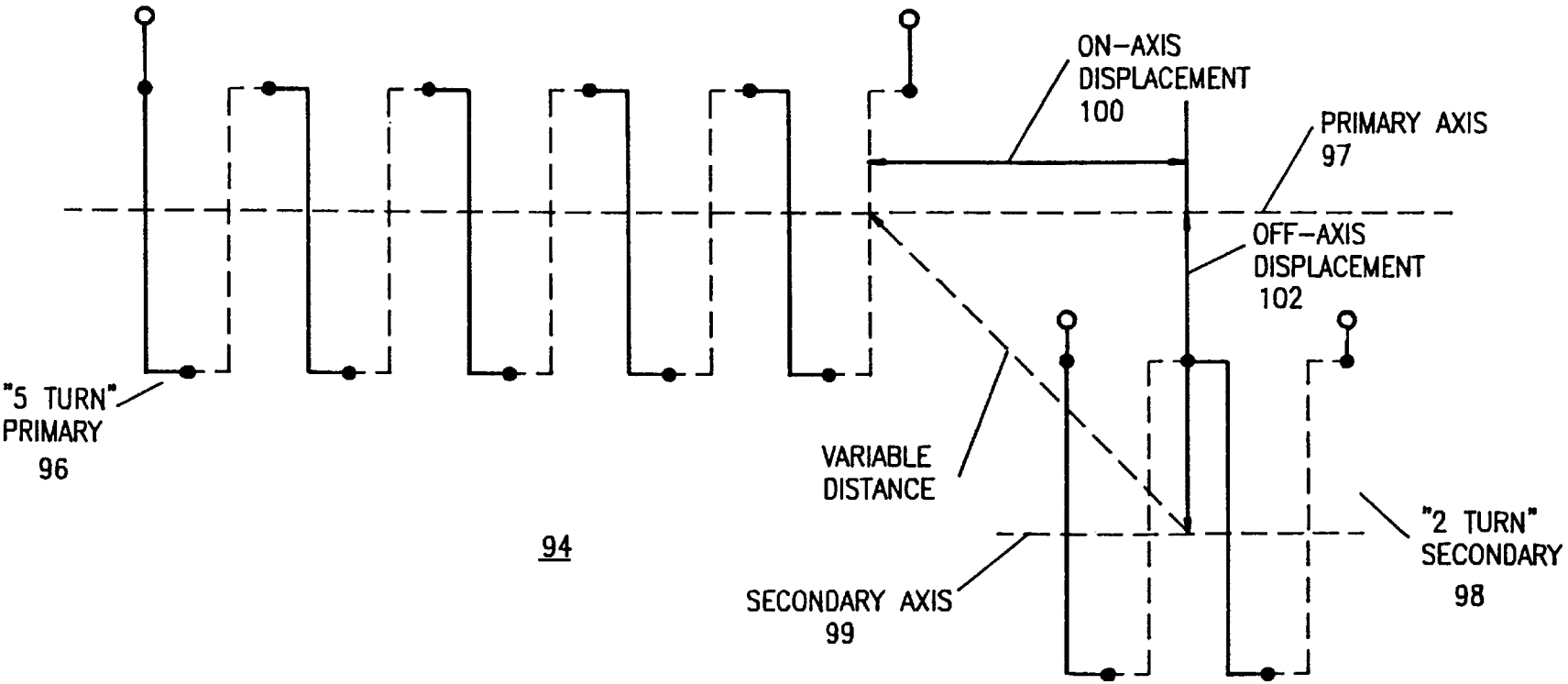
FIG. 6 illustrates a method of varying the coupling coefficient with a variable on-axis displacement of the secondary relative to the primary and a variable off-axis displacement of the secondary relative to the primary.

Referring to FIG. 6, there is shown a transformer 94 with a "five turn" primary, indicated at 96, and a "two turn" secondary, indicated at 98. The primary 96 has a primary axis 97 and the secondary 98 has a secondary axis 99. The secondary 98 is separated from the primary 96 by an on-axis displacement, indicated at 100, and by an off-axis displacement, indicated at 102 whereby the secondary axis 98 is displaced from the primary axis 97. It should also be understood that the secondary 98 can be rotated around its centroid as shown in FIG. 5

It is to be understood that the illustration of a five turn primary and a two turn secondary in the examples discussed herein is for explanation purposes only and that other primary/secondary ratios are contemplated by this invention.

Figure 7:
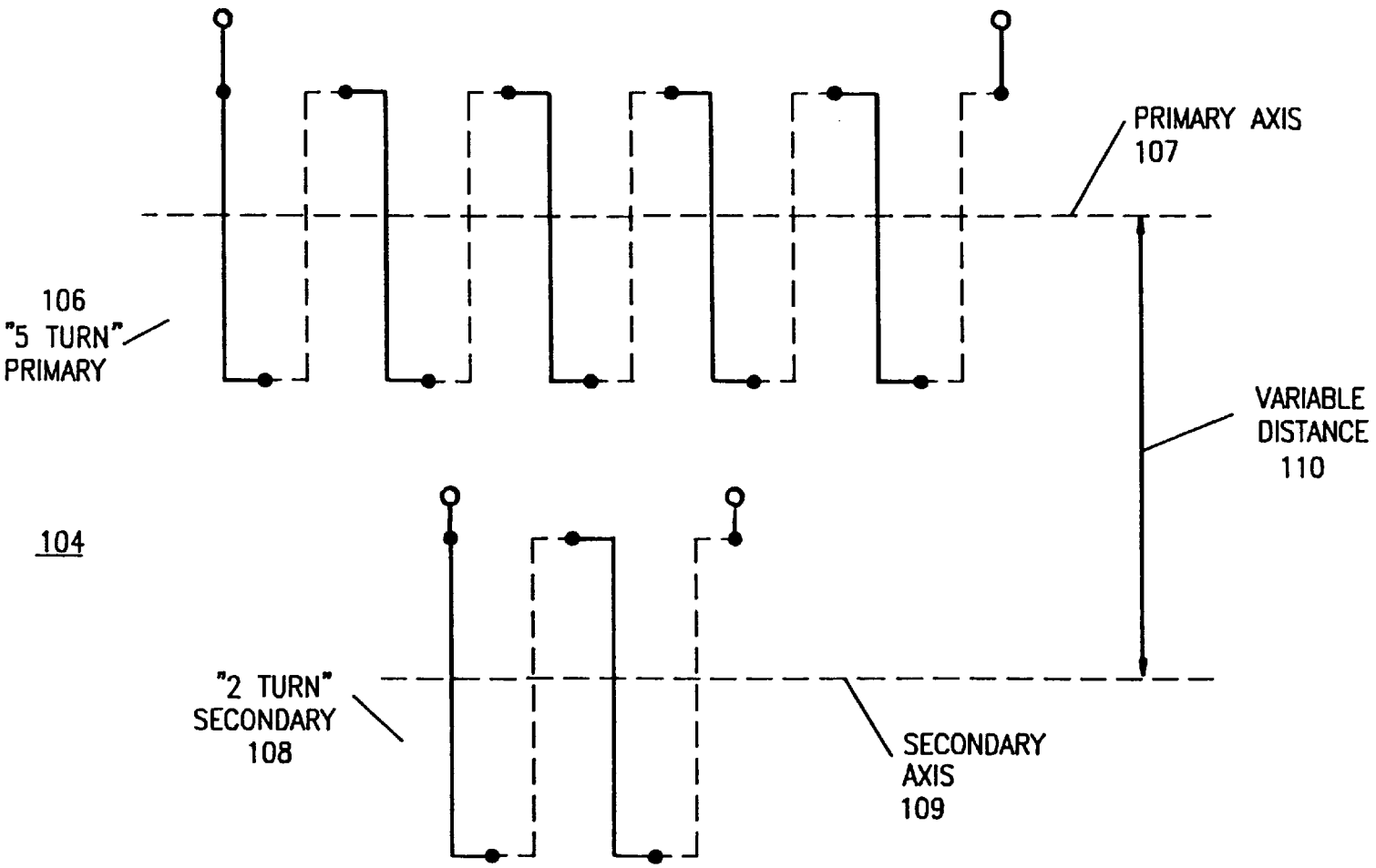
FIG. 7 illustrates a method of varying the coupling coefficient with the secondary on a secondary axis displaced a variable distance from the primary axis.

Referring to FIG. 7, there is shown a transformer 104 with a "five turn" primary, indicated at 106, and a "two turn" secondary, indicated at 108. The primary 106 has a primary axis 107 and the secondary 108 has a secondary axis 109. The secondary 108 is separated from the primary 106 by a distance 110 measured from the primary axis 107 to the secondary axis 109. As can be appreciated, secondary 108 can be rotated by a selectable angle around the center of secondary 108. In addition, the secondary 108 can be located anywhere along the secondary axis 109 and the secondary 108 can be rotated around its centroid as shown in FIG. 5.

Figure 8:
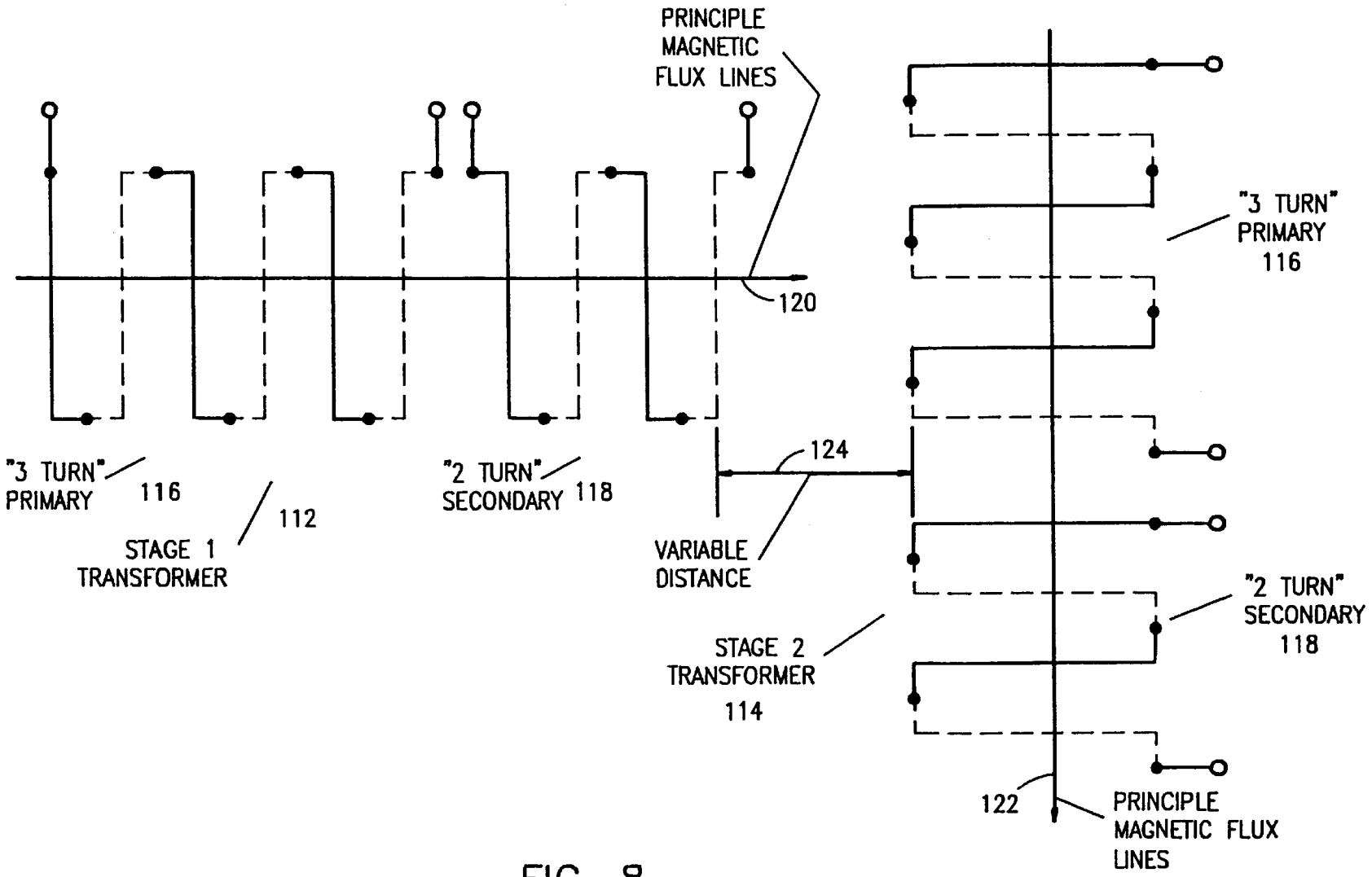
FIG. 8 illustrates an orthogonal placement of two transformers to minimize coupling.

Referring to FIG. 8, there is shown a stage 1 transformer, indicated at 112, and a stage 2 transformer, indicated at 114. The stage 1 transformer 112 and the stage 2 transformer 114 each have a "three turn" primary, indicated at 116 and a "two turn" secondary, indicated at 118. The stage 1 transformer 112 has an axis, indicated at 120, and the stage 2 transformer 114 has an axis, indicated at 122. The stage 1 transformer 112 is manufactured to be orthogonal to the stage 2 transformer 114 as determined by the position of the axes, 120 and 122. In addition, the stage 2 transformer 114 is manufactured at a distance, indicated at 124, from the stage 1 transformer 112. It should be understood that the distance between the stage 1 transformer 112 and the stage 2 transformer 114 is arbitrarily shown being measured as the distance indicated at 124, however, the distance between the two stages could be measured at any convenient points in the two stages. For example, the distance between the two stages could be measured from a centroid of one stage to the centroid of the other stage. The orthogonal layout solves the problems associated with "cross-coupling" of transformers in close proximity.

Figure 9:
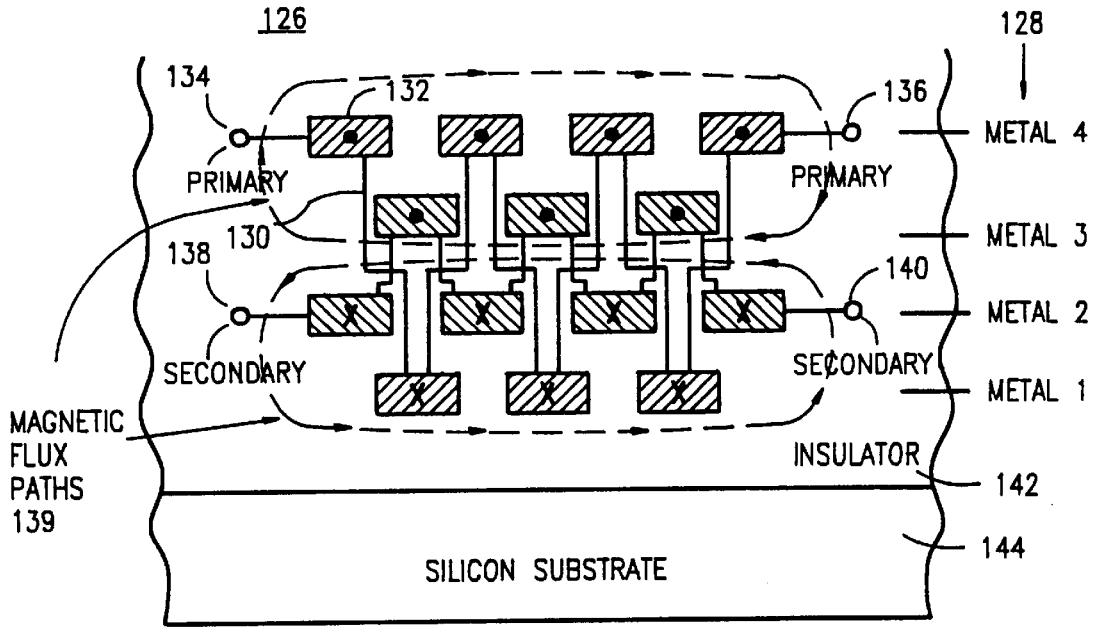
FIG. 9 is a cross-sectional view of a four-level metal on-chip transformer.

Referring to FIG. 9 there is shown a cross-sectional view of a transformer 126 that is constructed in four metal layers indicated at 128. Also shown are the interconnections between portions of the primary and secondary in different metal layers for example the connection indicated at 130 shows a connection of a portion 132 of the primary in the metal 4 layer with a portion 134 of the primary in the metal 1 layer. The dots in the cross-sectional views of the "windings" indicate that the current is flowing out of the face of the figure and the "x's" indicate that the current is flowing into the face of the diagram. The primary is shown between terminals 134 and 136 and the secondary is shown between terminals 138 and 140. The paths of the magnetic flux are indicated by 139. As discussed above, the transformer 126 is constructed in an insulator layer 142 formed on a silicon substrate 144.

Figure 10A:
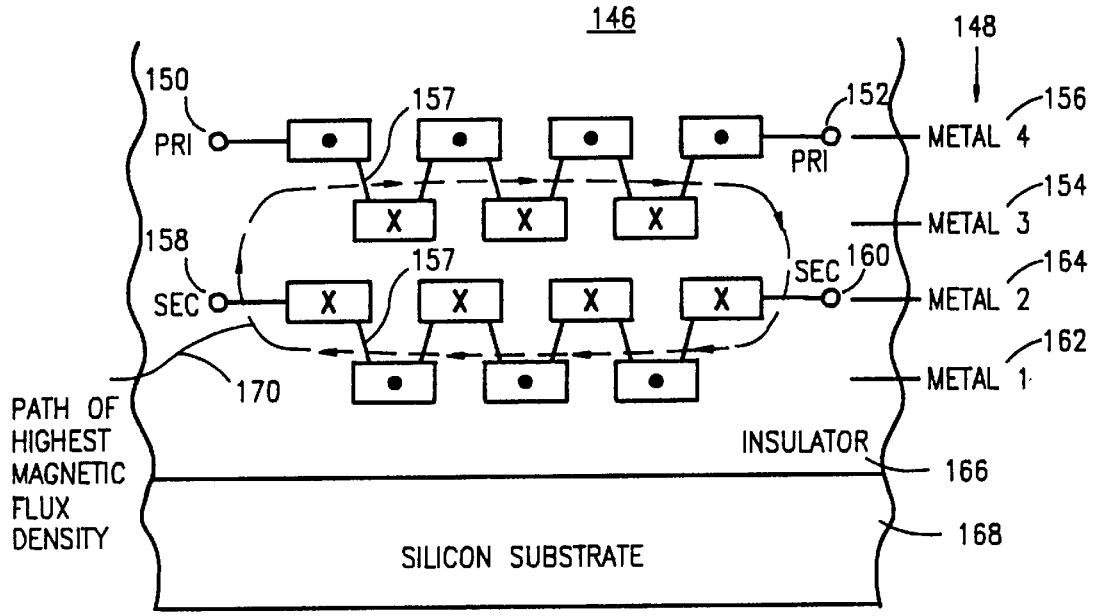
FIG. 10A illustrates an improved "Q" transformer utilizing a four-layer interconnect.

Referring to FIG. 10A there is shown a transformer 146 constructed in four metal layers indicated at 148. The primary is shown between terminals 150 and 152 and is shown being constructed in metal layer 3 154 and metal layer 4 156. As described above in the discussion relating to FIG. 9 the dots in the cross-section views of the "windings" indicate that the current is flowing out of the face of the figure and the "x's" indicate that the current is flowing into the face of the figure. Also, as described above, the interconnections between metal layers are indicated by lines such as 157. The secondary is shown between terminals 158 and 160 and is shown being constructed in metal layer 1 162 and metal layer 2 164. Also, as discussed above, the transformer 146 is constructed in an insulator layer 166 formed on a silicon substrate 144. The layout in FIG. 10A differs from the layout in FIG. 10B and the layout in FIG. 10A has a lower coupling coefficient and an improved Q by reducing magnetic flux density in the silicon substrate. The path of the highest magnetic flux density is indicated at 170 and shows that the path does not extend to an appreciable extent into the silicon substrate 168. By constructing the transformer 146 as shown, most of the magnetic flux density is constrained as shown and with the reduction of the magnetic flux density in the silicon substrate 168 the eddy current loss is reduced which improves Q.

Figure 10B:
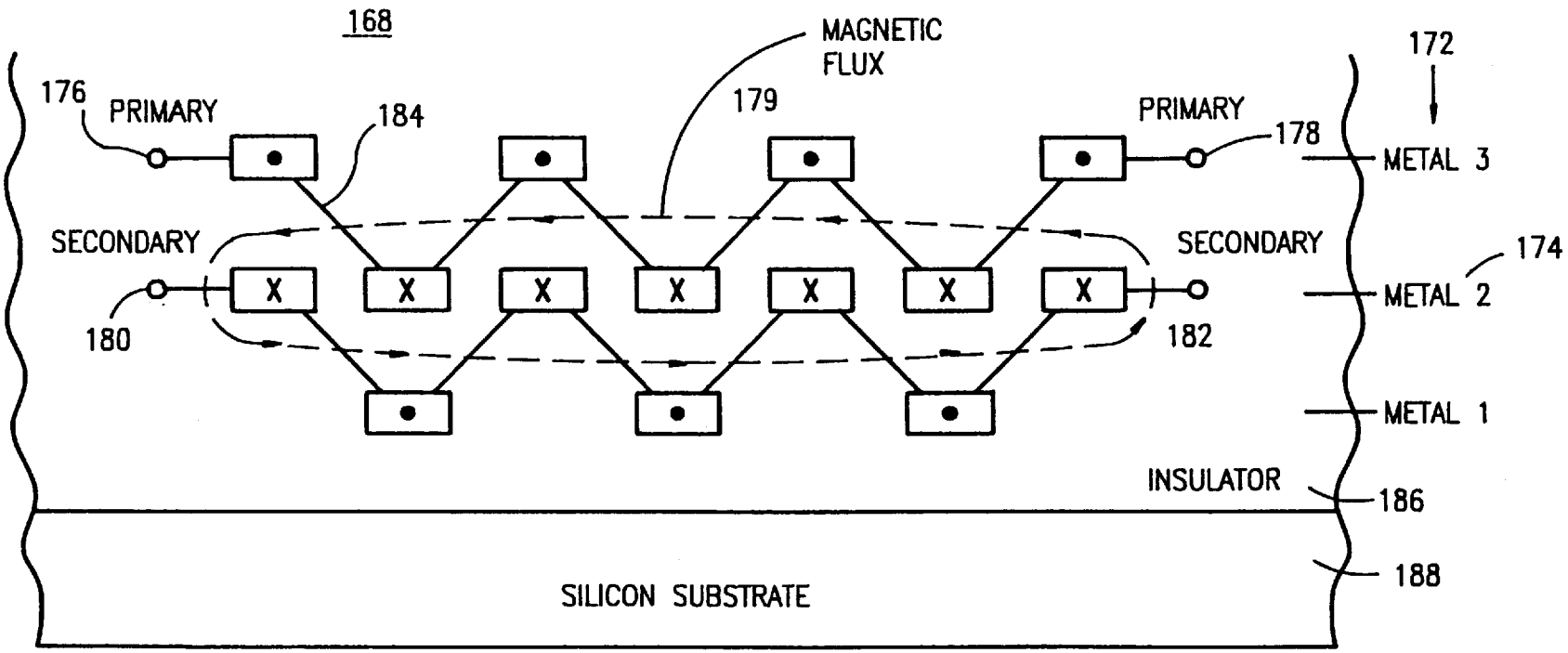
FIG. 10B illustrates the transformer shown in FIG. 10A utilizing a three-layer interconnect.

Referring to FIG. 10B there is shown a transformer 168 which is similar to the transformer 146 in FIG. 10A and which is constructed in three metal layers indicated at 172 rather than four by combining the portions of the windings shown in metal 2 layer 164 of FIG. 10A and metal 3 layer 154 of FIG. 10B into a single interconnect layer 174 which is metal layer 2 in FIG. 10B. The transformer 168 has a primary between terminals 176 and 178 and a secondary between terminals 180 and 182. As described above in the discussion relating to FIG. 9 the dots in the cross-section views of the "windings" indicate that the current is flowing out of the face of the figure and the "x's" indicate that the current is flowing into the face of the figure. The major path of magnetic flux, indicated at 179, shows that the path does not extend to an appreciable extent into the silicon substrate 188. Also, as described above, the interconnections between metal layers are indicated by lines such as 184. The metal layers 172 are constructed in an insulator layer 186 formed on a silicon substrate 188.

Figure 11:
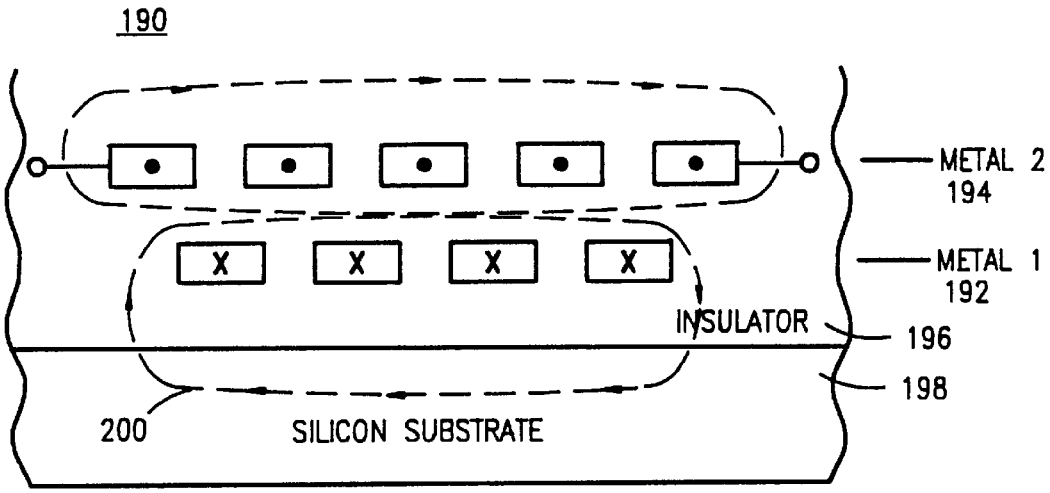
FIG. 11 illustrates magnetic flux from transformer in silicon substrate.

Referring to FIG. 11 there is shown a transformer 190 constructed in two metal layers, metal 1 layer 192 and metal 2 layer 194 formed in an insulator 196 which has been formed on a silicon substrate 198. As described above in the discussion relating to FIG. 9 the dots in the cross-section views of the "windings" indicate that the current is flowing out of the face of the figure and the "x's" indicate that the current is flowing into the face of the figure. The magnetic flux lines are indicated at 200 to illustrate that the magnetic flux lines penetrate the silicon substrate 198 which, as discussed above, causes eddy current losses and reduces the Q of the transformer from an ideal value.

Figure 12:
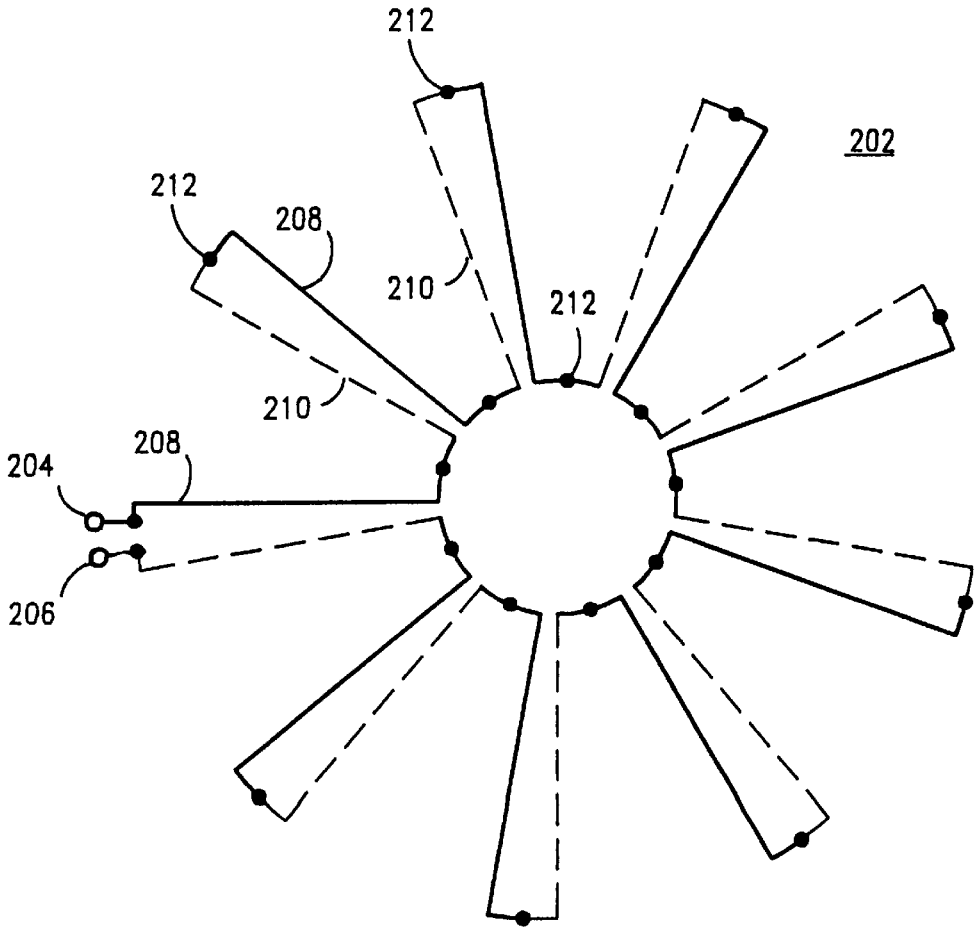
FIG. 12 illustrates a higher "Q" transformer using a toroidal layout.

To reduce the loss of Q by magnetic flux penetrating into the silicon substrate other constructions are possible such as the construction shown in FIG. 12 in which a transformer 202 is shown constructed in a toroidal layout. The transformer 202 is shown basically as an autotransformer with a single winding between terminals 204 and 206. As described above, the transformer 202 shown in FIG. 12 is constructed in two layers with the solid lines, such as indicated at 208, indicating a portion of the winding in one metal layer and the dashed lines, such as indicated at 210, indicating a portion of the winding in another metal layer. The dots, such as indicated at 212, connecting the solid lines with the dashed lines indicate the connections between metal layers and can be connections such as vias constructed between layers.

Figure 13:
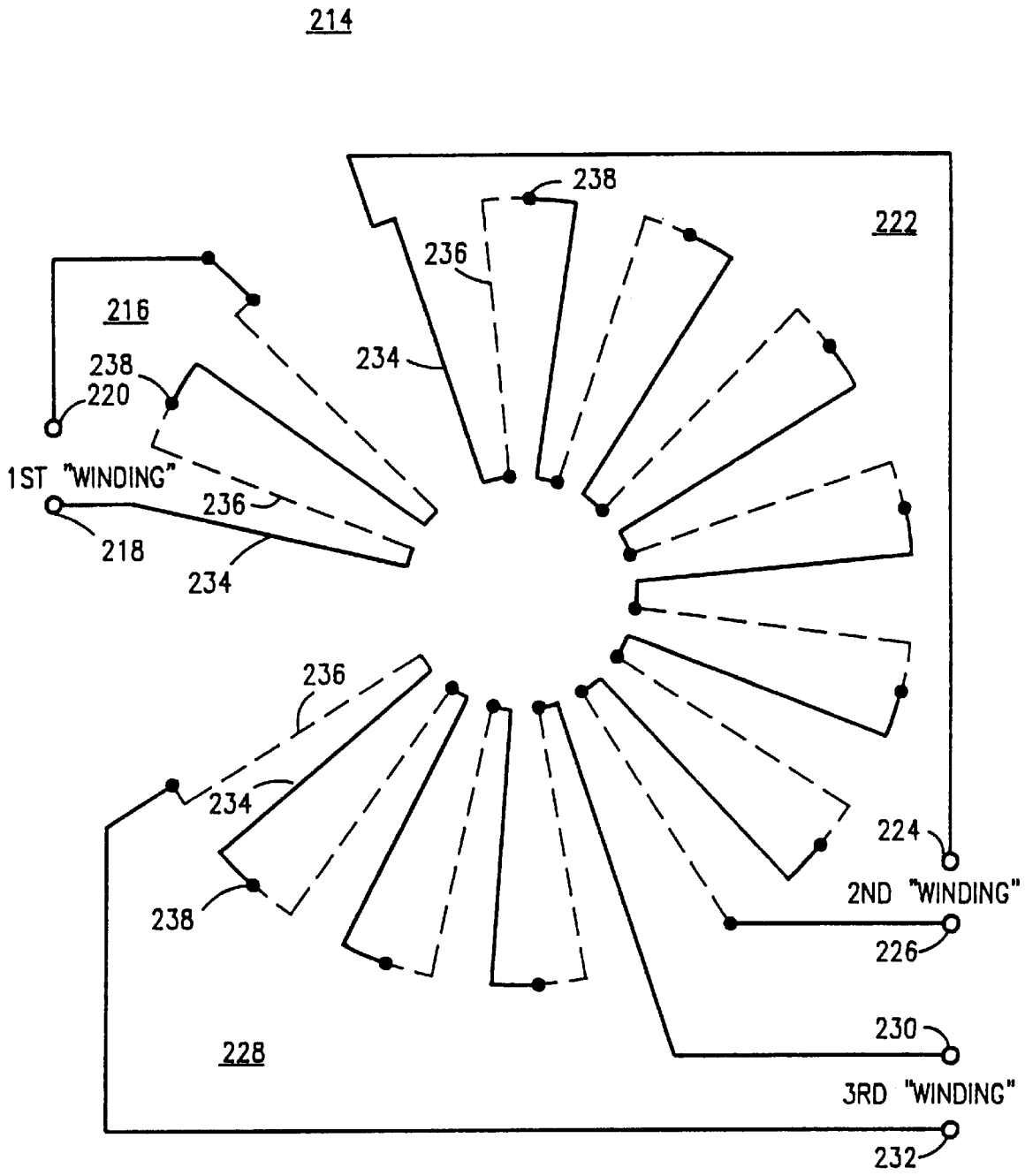
FIG. 13 illustrates a multi-winding toroidal layout transformer.

Referring to FIG. 13 there is shown a transformer 214 constructed in a toroidal layout with three "windings" with a first winding 216 between terminals 218 and 220, a second winding 222 between terminals 224 and 226, and a third winding 228 between terminals 230 and 232. As described above, the transformer 214 shown in FIG. 13 is constructed in two layers with the solid lines, such as indicated at 234, indicating a portion of the winding in one metal layer and the dashed lines, such as indicated at 236, indicating a portion of the winding in another metal layer. The dots, such as indicated at 238, connecting the solid lines with the dashed lines indicate the connections between metal layers and can be connections such as vias constructed between layers.

The foregoing description of the preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications which are suited to the particular use contemplated. All such modifications and variations are within the scope of the invention as determined by the appended claims when interpreted in accordance with the breadth to which they are fairly, legally, and equitably entitled.

What is claimed is:

1. An on-chip autotransformer, comprising:

an insulator layer;

a first metal layer in said insulator layer having windings of said autotransformer with currents flowing in first direction;

a second metal layer in said insulator layer having windings of said autotransformer with currents flowing in a second directions wherein said first direction is opposite to said second direction;

plugs connecting windings in said first metal layer to corresponding windings in said second metal layer; and nodes connected to each of said plugs, wherein said nodes allow either a signal to be input to the autotransformer or a signal to be referenced from the autotransformer, wherein the signal referenced from the autotransformer has a selected turns ratio depending upon which node is referenced.

2. The on-chip autotransformer of claim 1, wherein said windings in said first metal layer are connected to windings in said second metal layer.

* * * * *